United States Patent [19]

Marschak

[11] 4,359,947

[45] Nov. 23, 1982

[54] SHELVING ASSEMBLY

[76] Inventor: Howard J. Marschak, 1202 Crain St., Evanston, Ill. 60202

[21] Appl. No.: 129,112

[22] Filed: Mar. 10, 1980

[51] Int. Cl.[3] ..... A47F 5/12

[52] U.S. Cl. ..... 108/1; 108/111; 211/186

[58] Field of Search ..... 108/111, 1, 6, 4, 149, 108/151, 60, 61, 16; 211/188, 190, 49 D, 134, 186

[56] References Cited

U.S. PATENT DOCUMENTS

| | | | |
|---|---|---|---|
| 327,592 | 10/1885 | Reed | 108/1 |
| 366,051 | 7/1887 | Weatherley | 211/186 X |
| 947,140 | 1/1910 | Wolkerstorfer | 211/186 X |
| 1,282,104 | 10/1918 | Mork | 211/188 X |
| 1,900,610 | 3/1933 | Mullins | 108/1 |
| 3,223,467 | 12/1965 | Jafelice | 108/151 |
| 3,424,315 | 1/1969 | Farren | 211/184 |
| 3,487,950 | 6/1970 | Alpert | 211/134 X |
| 3,900,112 | 8/1975 | Azzi et al. | 211/49 D |

FOREIGN PATENT DOCUMENTS

| | | | |
|---|---|---|---|
| 264047 | 8/1968 | Austria | 108/111 |

*Primary Examiner*—Francis K. Zugel
*Attorney, Agent, or Firm*—Tilton, Fallon, Lungmus

[57] ABSTRACT

A shelving assembly particularly useful for displaying or storing merchandise in commercial establishments in any of several ways tailored to meet the needs of that establishment. The components are capable of being combined to produce an assembly with any selected number of inclined shelves where automatic forward gravity feed of the articles to be supported upon said shelves is desired. Alternatively, the same components may be assembled to provide a unit having any desired number of horizontal shelves. Again, depending on the needs of the user, such shelves may be oriented so that protective rims extend about their horizontal top surfaces, or they may be oriented so that no such rims are provided. Dividers may be attached to the shelves to segregate the articles to be supported thereon and, especially when such shelves are to be assembled in inclined positions, stop members may be affixed to the shelves adjacent their forward edges to retain articles sliding forwardly upon such shelves under the influence of gravity.

33 Claims, 21 Drawing Figures

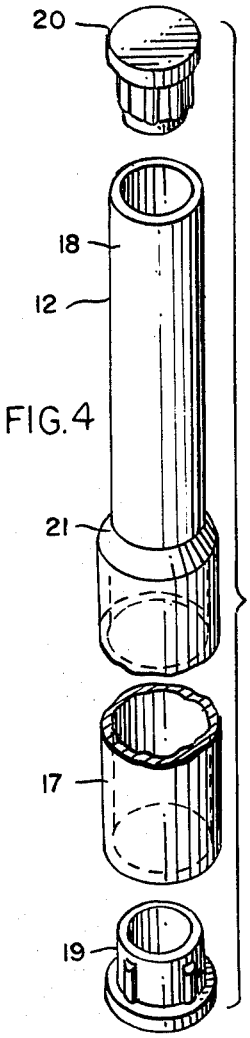
FIG. 4
FIG. 1
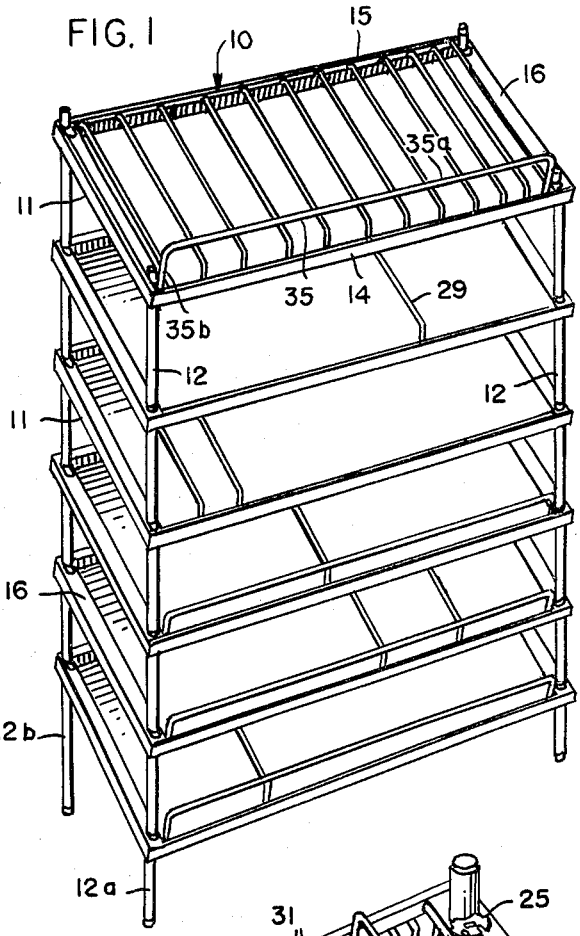
FIG. 5
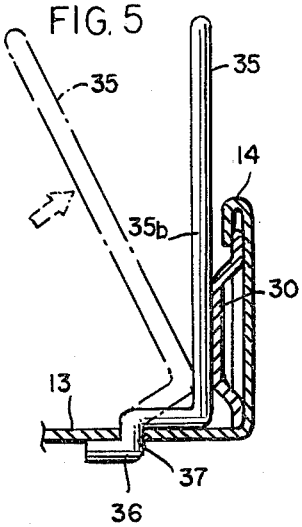
FIG. 6
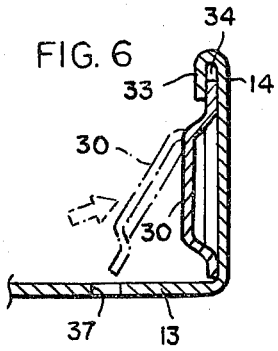
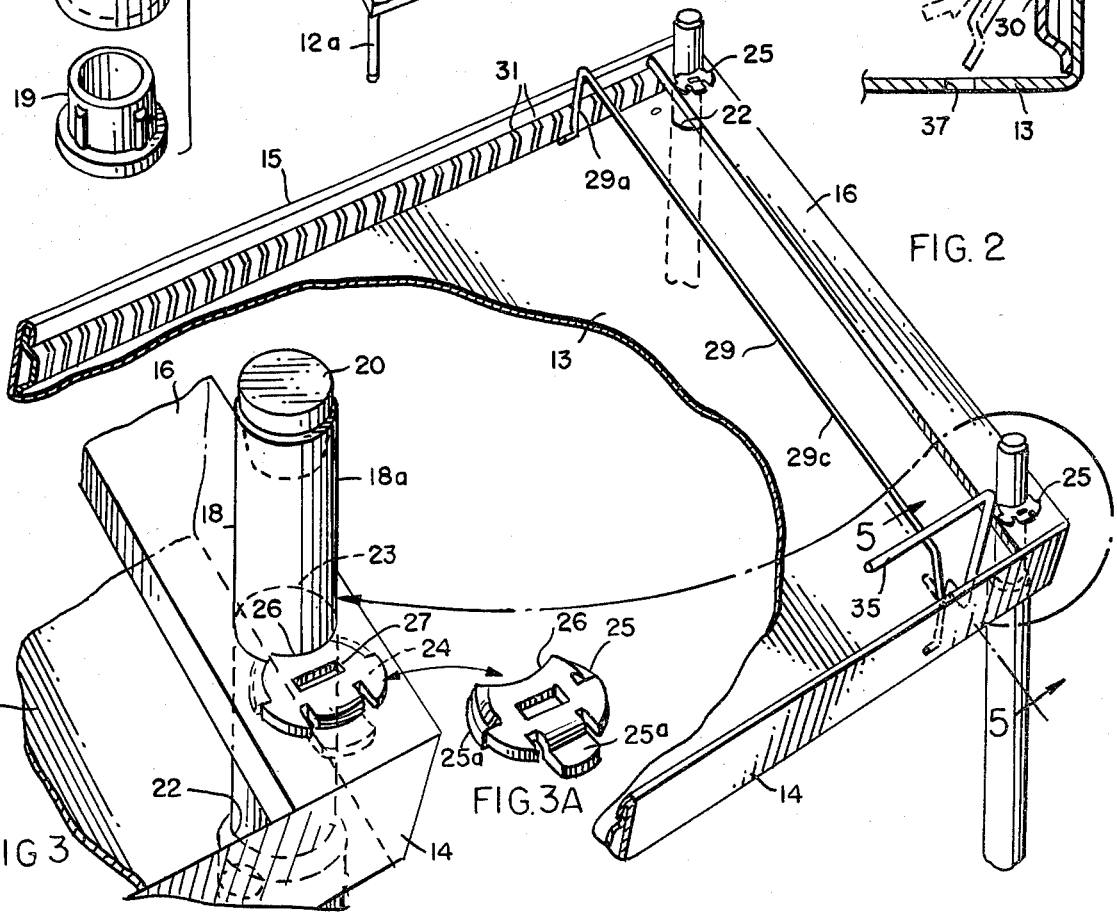
FIG. 2
FIG 3
FIG. 3A

SHELVING ASSEMBLY

BACKGROUND AND SUMMARY

Modular display units have been known in the past, and it has also been well known to provide display racks which may be assembled to provide any selected number of shelves. See, for example, U.S. Pat. Nos. 3,730,601, 3,507,399, 3,851,601, and 3,465,898. Display assemblies have also been provided in which the shelves may be mounted upon supporting structures in either horizontal or inclined positions. See Pat. Nos. 3,915,097, 3,126,101, 3,120,199, and 3,841,237. However, despite the need for versatility and adaptability in shelving construction, there remains a need for a shelving assembly which is simple and relatively inexpensive in construction, which allows the shelves to be arranged to whatever height meets the user's needs, and which permits such shelves to be oriented in either horizontal or inclined positions.

A main object of this invention therefore lies in providing an assembly which meets all of such needs and which, in addition, may be easily and quickly assembled or disassembled by a user. A further object is to provide a shelving assembly which is relatively sturdy when the components are combined in any selected mode of assembly, and in which certain components are interlocked against inadvertent detachment when the assembly is complete. A still further object is to provide a shelving assembly in which the same shelf units may be joined with post segments so that such shelves are either horizontal or sloping and, in the latter case, have either article-retaining rims or provide smooth un-rimed top surfaces.

In brief, the shelving assembly includes a plurality of rectangular metal shelves arranged in a vertically-spaced series. Each shelf is composed of a planar support panel having side edges which are turned upwardly and then inwardly to define a pair of side flanges parallel with and spaced above the support surface. In addition, the shelf has upstanding front and rear walls or flanges. In referring to such flanges and side edges as being turned "upwardly", it is to be understood that such terminology describes the relationships as they exist when the shelves are oriented to provide a perimetric retaining rim or border about each shelf; if no such rim is desired, then the shelves are simply assembled in inverted positions.

The planar support panel of each shelf is provided with a circular opening adjacent each of its corners. Above each of such openings, in the side flanges of the shelf, are two merged openings which may be referred to as the first (or primary) opening and the second (or secondary) opening. Each of the first and second openings is formed in the flange as a circular opening and, depending on the selected orientation of the shelf (either inclined or horizontal), either the first or the second opening in such flange will be vertically aligned with the opening in the main support panel of the shelf directly therebelow.

Successive shelves are joined by tubular posts segments, each of which has a lower cylindrical body section and an upper neck section of reduced cross sectional dimensions. If the parts are to be assembled with the shelves in inclined positions, then the neck section of each post segment is inserted upwardly through a corner opening in the support panel of a shelf and through the aligned first or primary opening in the flange directly thereabove. The end portion of the neck section protruding above the flange of the shelf provides a mounting spindle adapted to be inserted and snugly received within the body section of the next post segment in the vertical series. In such manner, the post segments and shelves may be stacked to produce an assembly having whatever number of shelves is needed to suit the requirements or preferences of the user.

If horizontal orientation of the shelves is desired, then the neck sections of the post segments are instead inserted upwardly through the openings of the support panels and the second or secondary openings of the flanges. Should the user desire to have the supporting surfaces of the shelves be rimless or borderless, then such shelves are simply inverted and the upstanding neck sections of the post segments are inserted upwardly through the same openings but in reverse order. Such shelf reversal is made possible because the aligned openings of the support panel and side flanges (either the first or second openings of the merged pair in such flanges) are of the same diameter and are only slightly larger than the outside diameter of the neck section.

Rigidity is achieved because of a number of factors. Plug elements are inserted into the unused first or second openings of the side flanges, each such plug element having an arcuate indentation which is adapted to bear tightly against the outer surface of the neck section of a post segment. In addition, the neck and body sections of each post merge to define a tapered or rounded shoulder which tends to wedge into the lowermost opening at the corner of each shelf. Furthermore, the openings as formed in the support panel and flange of each shelf are circular in outline; however, if the shelves are to be inclined, the neck section of each post segment extends through the aligned openings at an angle to produce tight engagement between the neck section of the post segment and edge portions defining the shelf openings.

Different plug constructions are disclosed. In addition, the disclosure includes important features of the front and rear walls of the shelves, the interrelationship between such walls and slotted insert strips, and the cooperative relationship between such slotted insert strips and removable divider elements as well as detachable stop members.

Other objects, features, and advantages of the shelving assembly will become apparent from the specification and drawings.

DRAWINGS

FIG. 1 is a perspective view of the shelving assembly with the shelves stacked in their inclined positions.

FIG. 2 is an enlarged fragmentary view illustrating the interrelationship between a shelf and the supporting post segments.

FIG. 3 is a still further enlarged fragmentary perspective view of a portion of the structure depicted in FIG. 2.

FIG. 3A is a perspective view of the plug element removed from the structure as depicted in FIG. 3.

FIG. 4 is a perspective view of a post segment showing a bottom cap which may be fitted into the open end of the lowermost segment and also showing a top cap which may be fitted into the upper opening of the uppermost post segment of a series.

FIG. 5 is an enlarged vertical sectional view showing the interrelationship between the front wall of a shelf, the slotted insert strip retained by that front wall, and a wire stop member secured to the shelf.

FIG. 6 is a view similar to FIG. 5, but with the wire stop member omitted, showing the interfitting relationship between the front wall of the shelf and the insert strip.

DETAILED DESCRIPTION

Figure 7:
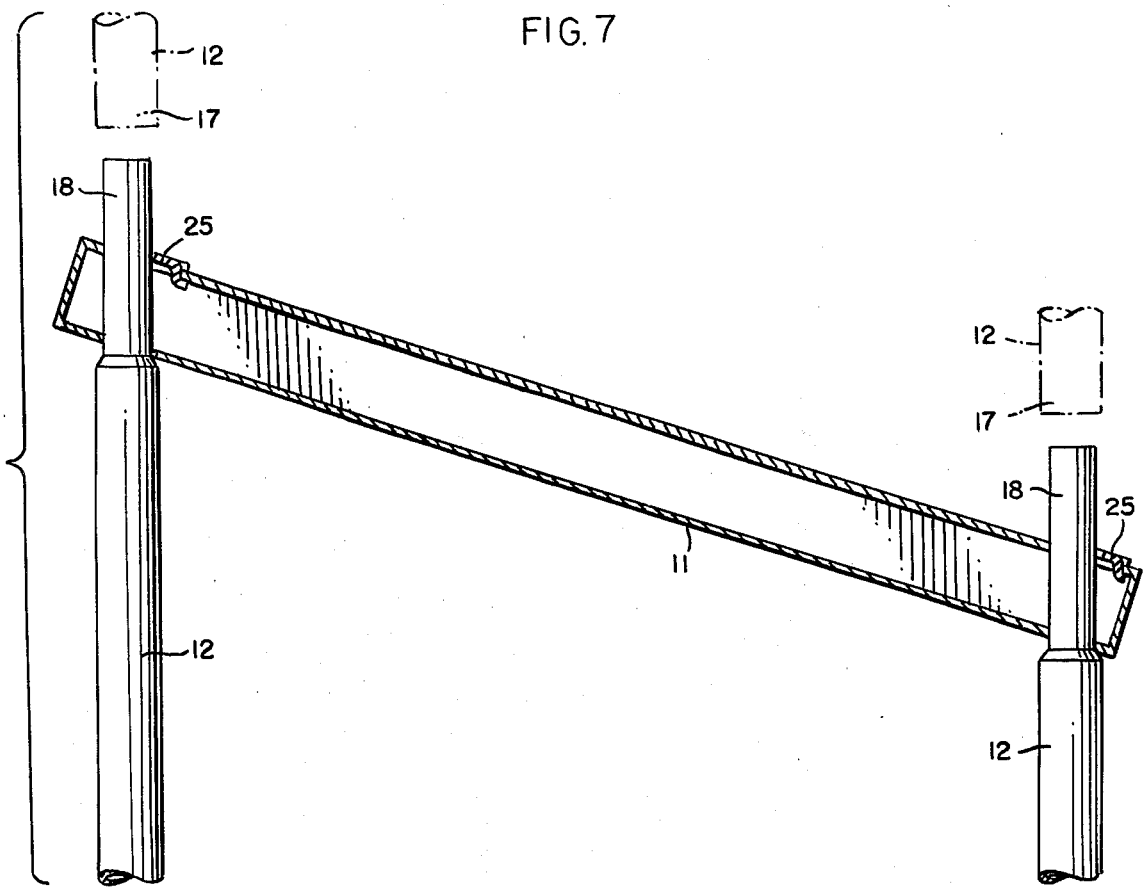
FIG. 7 is a vertical sectional view illustrating the relationship between the vertical post segments and an inclined shelf.

Referring to FIGS. 1–4, the numeral 10 generally designates a shelving assembly having a plurality of inclined parallel rectangular metal shelves 11 arranged in a vertically-spaced series and secured in that arrangement by interconnected corner post segments 12. The shelves are identical in construction, each shelf having a planar support panel 13 and upwardly turned front and rear walls 14 and 15. In addition, the side edges of each shelf are turned upwardly and then inwardly to provide side flanges 16 which are parallel with and spaced upwardly from the support panel 13.

Post segments 12 are identical except for the lowermost segments 12*a* and/or 12*b* which are of different lengths so that the assembly will rest upon a supporting surface with the shelves 11 in the inclined positions shown and with the post segments 12 in vertical condition. Each segment 12 is tubular, has a circular outline when viewed in section, and is distinguished by an elongated lower body section 17 and a shorter upper neck section 18 (FIG. 1). A plastic (or metal) cap or foot 19 may be inserted into the open lower ends of the lowermost segments of a series, and similar caps 20 may be fitted into the open tops of the uppermost segments.

As shown most clearly in FIG. 4, the outside diameter of neck section 18 is substantially smaller than that of body section 17. Between the body and neck sections is a transition zone which takes the form of a sloping or rounded shoulder portion 21.

The planar support panel 13 of each shelf is provided with circular openings 22 adjacent the corners thereof. The openings are circlar and are dimensioned to be only slightly larger than the outside diameter of the neck portion 18 of each post segment. Each such opening 22 is therefore substantially smaller than the outside diameter of the body section 17 of each post segment.

Figure 10:
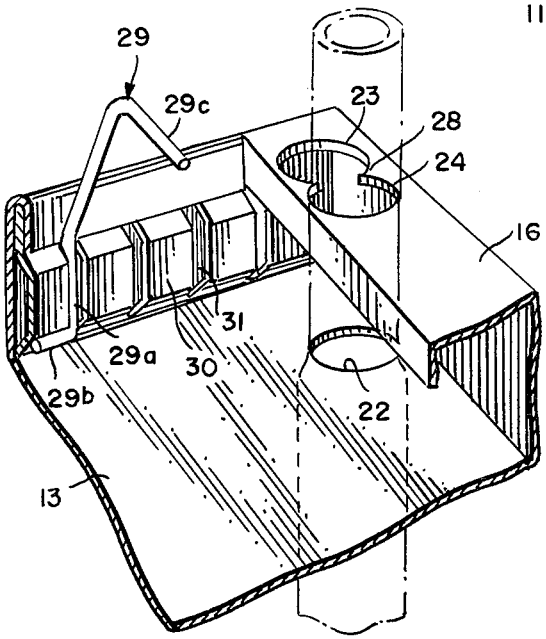
FIG. 10 is a fragmentary perspective view illustrating the relationship of parts when a shelf is horizontally disposed with the front and rear walls thereof facing upwardly.

Above each opening 22, the side flanges 16 of the shelves are provided with merged circular openings 23 and 24, as illustrated most clearly in FIG. 10. When the structure is assembled as depicted in FIGS. 1–3 and 7, with the shelves in inclined positions, opening 23 may be regarded as the primary opening and opening 24 as the secondary opening. With the shelves so inclined, the primary opening 23 in the side flange 16 is vertically oriented with respect to opening 22 directly therebelow in the support panel 13. The tubular neck section 18 of post segment 12 extends upwardly through the aligned pair of openings 22 and 23 as shown in FIG. 3. It will be noted that the upper end 18*a* of the neck section continues well above flange 16 of the shelf. If that shelf happens to be the top shelf of the series, then the open upper end of the neck section may be capped (FIG. 3), whereas if the shelf is further down in the series then the projecting upper end portion 18*a* of the neck section will be telescoped into the body section 17 of the post segment 12 directly thereabove (FIG. 7). The parts are dimensioned so that the upper neck section of one segment fits snugly within the scoket defined by the body section of the next segment, thereby providing rigid segmented corner posts and a wobble-free shelving assembly.

Prior to insertion of the neck sections of the post segments into the openings of a shelf, the secondary opening 24 is closed by a plug 25. In the embodiment of FIGS. 1–14, the plug 25 takes the form of a metal disc of a diameter larger than opening 24. A plurality of tongues or tabs 25*a* radiate outwardly from points circumscribed by the periphery of the disc and, as shown most clearly in FIG. 3A, extend downwardly and then outwardly so that the upper surfaces near the free ends of the tabs are spaced below the undersurface of the remainder of the disc. When the disc is in place, tabs 25*a* engage the underside of flange 16 about secondary opening 24 while other peripheral portions of the disc engage the top surface of flange 16. It is believed apparent that the disc or plug 25 can be inserted or removed only when post segment 12 is not connected to the shelf, since such insertion or removal of the plug takes place from or in the direction of primary opening 23. When the neck section 18 of a post segment extends upwardly through opening 23 of the flange, a plug 25 fitted into secondary opening 24 is effectively locked in place.

Plug 25 has an arcuate indentation 26 which defines an arc of circular opening 23 when the parts are assembled as shown in FIG. 3. The arcuate edge 26 should fit tightly against the outer surface of neck section 18 to help hold the parts (i.e., shelf and post) tightly together. To assist in inserting the plug into secondary opening 24, and to facilitate rotating the plug so that arcuate edge 26 aligns properly with the border of primary opening 23, the disc-like plug may be provided with a cental slot 27 into which the blade of a screwdriver or other suitable tool may be inserted.

Figure 12:
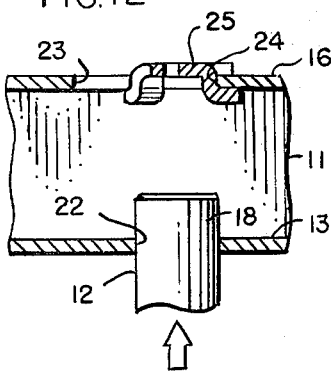
FIGS. 12–14 are fragmentary sectional views, with details somewhat exaggerated, illustrating the relationships and deformations which occur when the parts are assembled so that the shelves are oriented in their inclined positions of FIGS. 1–3.
Figure 13:
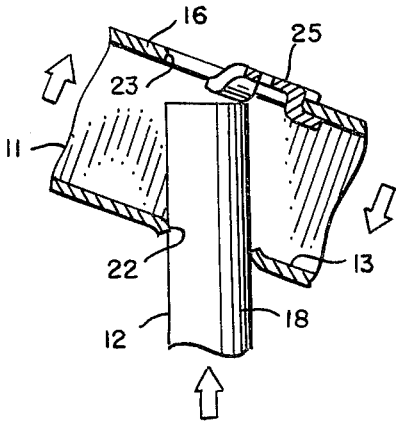
Figure 14:
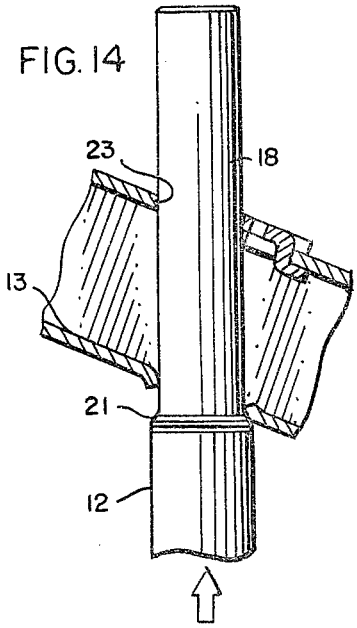

FIGS. 12–14 illustrate the steps of assembling the parts, with deformations in the shelf being depicted in exaggerated form in an effort to show more clearly the stresses created as a result of the tight interfit between each shelf and its corner post segments. In the first step of assembling the parts (FIG. 12), the plug element is first fitted into place in opening 24 and then the end of neck section 18 of the post segment is urged upwardly through the lower opening 22 in support panel 13. Thereafter, the shelf is tipped with respect to the post segment so that the end of the post may be inserted through opening 23 in flange 16 (FIG. 13). Since a close sliding fit is provided between the neck section 18 of the post segment and opening 22 in the panel during the initial insertion step (FIG. 12), the tipping action brings opposite side edges of opening 22 into more forceful engagement with the neck section 18. Such forceful engagement may, as shown in exaggerated form in FIG. 13, cause slight deformation of portions of the edge defining opening 22. Finally, the neck section is inserted through opening 23 until the shoulder 21 of the post segment 12 engages the underside of panel 13 (FIG. 14). During the final step of insertion, as the neck section is urged upwardly through opening 23, forceful engagement between the parts again takes place and slight deformation of edge portions of opening 23, and particularly of the pointed projections 28 between the merged openings, may take place. The result is a tight frictional fit between the inserted post segment 12 and the metal shelf 11.

The assembly may be constructed to provide any desired angle of inclination for shelves 11, although in general such angle should fall within the range of about 10 to 20 degrees from the horizontal. The angular orientation of the shelves causes articles stored thereon to slide forwardly where they are easily viewed and readily accessible. To facilitate the gravity feed of articles towards the front of each shelf, and to aid in organizing the articles supported on each shelf, wire dividers 29 may be attached to the shelves as indicated in FIGS. 1, 2, and 10.

Insert members or strips 30 are provided for mounting the shelf dividers. As shown most clearly in FIGS. 2, 6, and 10, each insert strip 30 is horizontally elongated and is provided with a series of horizontally-spaced recesses or apertures 31. One insert strip extends along front wall 14 and the other along rear wall 15, and opposing recesses of the two strips may receive the downwardly-extending end portions **29*a* of a wire divider 29 in the manner represented in FIG. 10. The laterally-turned tip 29*b* at the extreme ends of each divider, and the spring action of the elongated intermediate portion 29*c*** of such divider, acts to lock the divider in the selected recesses.

The mounting of each insert strip is shown in FIG. 6. Both the front and rear walls of each shelf have inwardly and downwardly turned lips 33 which are spaced from the inside surfaces of such walls to define downwardly-facing channels 34. An insert member is secured in place by inserting its upper edge into the channel and then shifting it into parallel relation with the front (or rear) wall of the shelf (FIG. 6). The insert strip is removable only by a reversal of such movements, and such reversal is prevented by the spring dividers 29 which are fitted into place in the manner already described.

In some cases it may be desirable to provide stop elements 35 along the front walls of the shelves to prevent larger articles from falling off of such shelves. Each stop element or member 35 is formed of wire, has a horizontally elongated intermediate portion **35*a* and a pair of depending arms 35*b* terminating at their lower ends in hook portions 36. As shown most clearly in FIG. 5, the hooks 36 extend downwardly through apertures 37 formed in the support panel 13 of each shelf. The hook portions are so shaped, and the apertures so located, that when the stop members 35 are in place the depending arms 35*b* will be braced against the insert strip 30 retained by front wall 14 or by the front wall itself (should the insert member be omitted). The manner of attachment of the stop member is indicated in broken lines in FIG. 5**.

Figure 8:
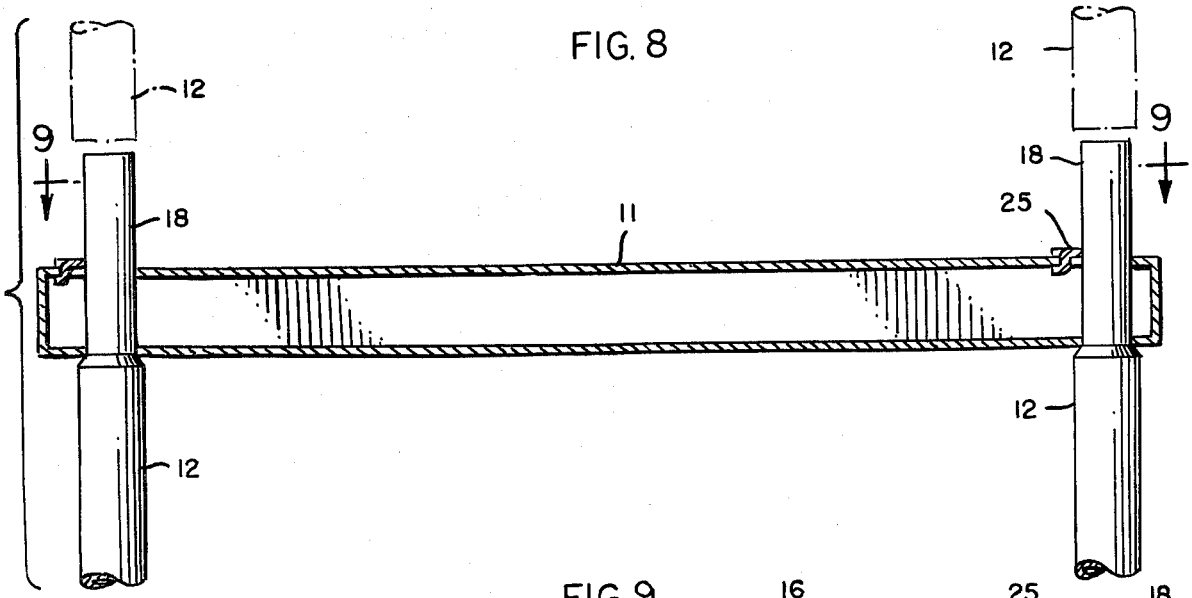
FIG. 8 is a vertical sectional view similar to FIG. 7 but showing the relationship of parts when the shelf is oriented in horizontal condition.
Figure 9:
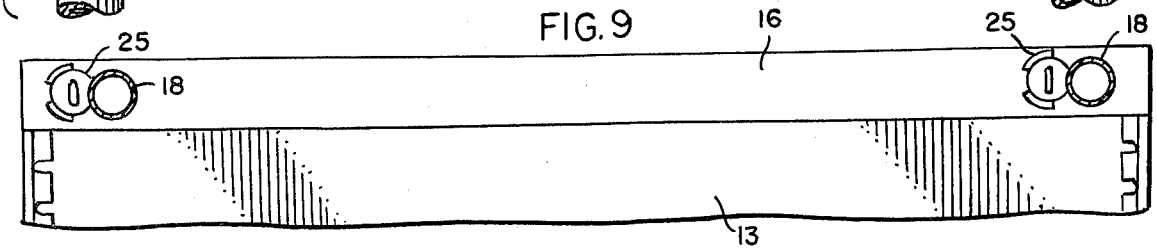
FIG. 9 is a horizontal sectional view taken along line 9—9 of FIG. 8.
Figure 11:
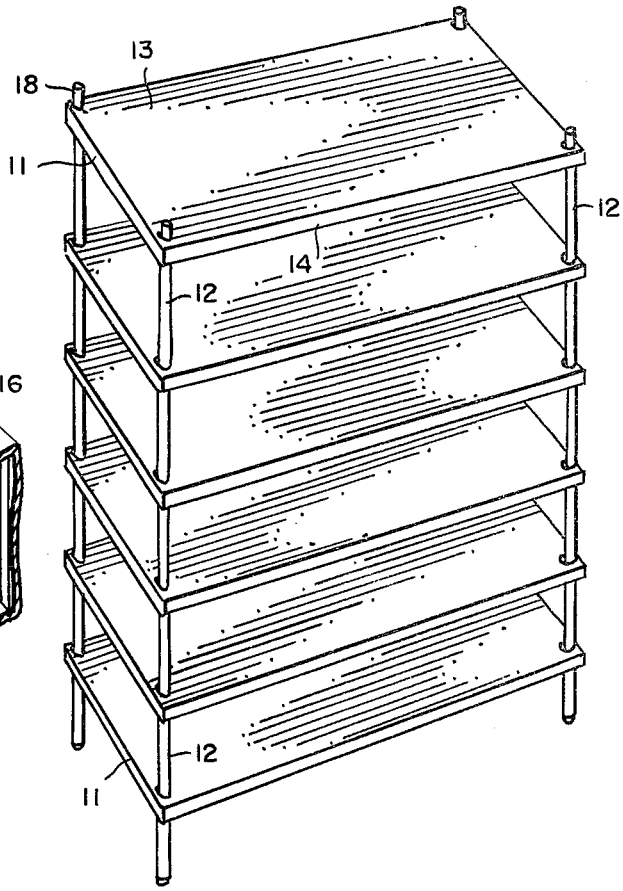
FIG. 11 is a perspective view of an assembly in which the shelves are oriented in horizontal positions but with the front and rear retaining walls projecting downwardly.

If the user desires an assembly with horizontal shelves rather than inclined shelves, then plugs 25 are inserted into openings 23 of flanges 16 and the neck sections of the post segments are inserted through aligned openings 22 and 24, as indicated in FIGS. 8–10. Those figures show the shelves arranged with the front and rear walls thereof extending upwardly to help retain articles stored thereon; however, if desired, the shelves may be inverted so that the supporting surfaces of the shelves are smooth and free of such retaining means (FIG. 11). It is particularly significant in that connection that such reversal or inversion of the shelves is possible because openings 22 and 24 in panel 13 and flange 16, respectively, are of the same diameter.

Figure 15:
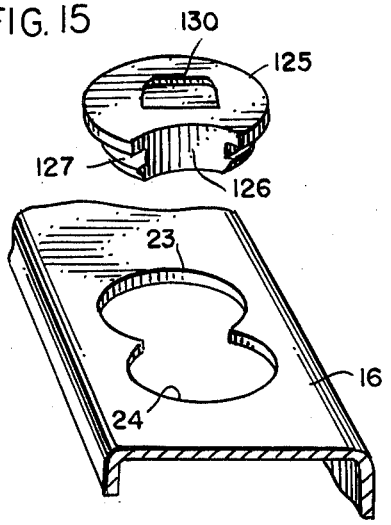
FIGS. 15 and 16 illustrate an alternate plug construction and its relationship with the side flange of a shelf in disassembled (FIG. 15) and assembled (FIG. 16) condition.
Figure 16:
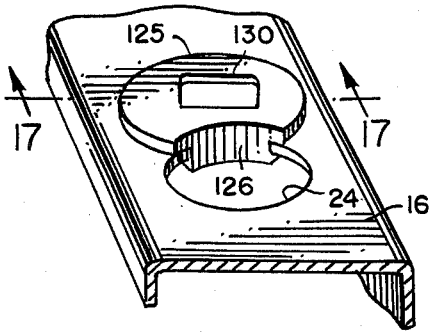
Figure 17:
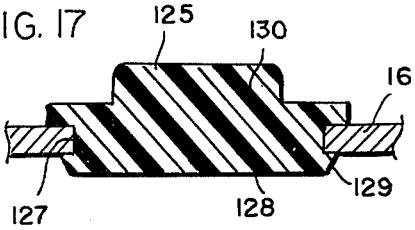
FIG. 17 is an enlarged cross sectional view taken along line 17—17 of FIG. 16.

FIGS. 15–17 illustrate a variation of the plug structure for closing off the unused opening 23 or 24 in the side flange 16 of each shelf. Plug 125 is formed integrally of a material such as resilient plastic and is generally disc-shaped with an arcuate indentation 126. A perimetric groove 127 has substantially the same diameter as that of opening 23 (or 24), and the lower portion 128 of the plug is provided with a tapered side wall 129 to facilitate insertion of the plug into the selected opening. A handle or tab 130 may be provided to facilitate such insertion.

While plug 125 performs the same functions following insertion as plug 25, it may be inserted either before or after a post segment has been joined to a shelf, unlike plug 25 which must be positioned prior to attachment of the post segment. Such insertion of plug 125 is achieved simply by urging its tapered lower portion 129 downwardly into the selected opening 23 or 24, causing slight deformation of the plug's lower portion until that portion has cleared the opening and the parts are interlocked as depicted in FIGS. 16 and 17.

Figure 18:
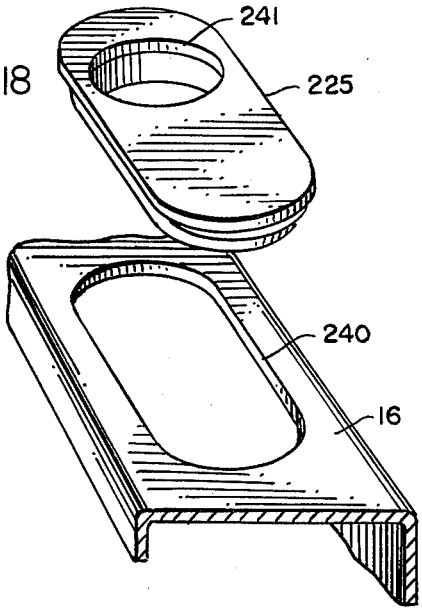
FIGS. 18 and 19 are perspective views depicting another plug construction, such plug and side flange being shown disassembled in FIG. 18 and assembled in FIG. 19.
Figure 19:
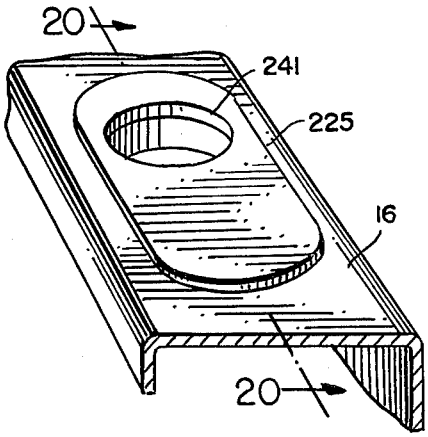
Figure 20:
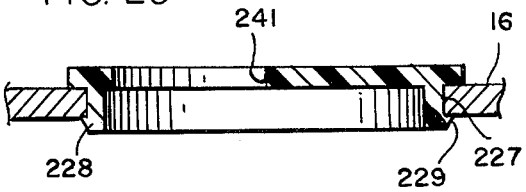
FIG. 20 is an enlarged sectional view taken along line 20—20 of FIG. 19.

FIGS. 18–20 illustrate another type of plug 225 which is similar to plug 125 to the extent that they are both formed of a resilient or yieldable material. A non-brittle polymeric material such as polypropylene or some other polyolefin has been found effective, but any of a variety of materials having similar properties may be used. Plug 225 is adapted to be received in an elongated opening 240 formed in flange 16 in place of merged openings 23 and 24. The opening 240 may be oblong or obround as shown and interlocks with plug 225 in essentially the same manner as disclosed with regard to plug 125. Specifically, plug 225 has a lower portion 228 with a tapered or beveled side wall 229. Above lower portion 228 is a perimetric groove 227 of the same size as opening 240. At one end of the oblong plug is a circular opening 241, and the plug may be secured within flange opening 240 in either of two positions; that is, in the position depicted in FIGS. 18 and 19, with opening 241 away from the viewer, or in a 180 degree reversed position with opening 241 nearer the viewer. In one case, opening 241, dimensioned to firmly but slidably receive the neck section of a post segment, will be disposed in vertical alignment with lower opening 22 in the shelf when the shelf is inclined; in the other position, opening 241 will be vertically aligned with opening 22 when the shelf is in a horizontal position.

While in the foregoing I have disclosed embodiments of the invention in considerable detail for purposes of illustration, it will be understood by those skilled in the art that many of these details may be varied without departing from the spirit and scope of the invention.

I claim:

1. A shelving assembly comprising a plurality of inclined parallel rectangular metal shelves arranged in vertically-shaped series; each shelf having a support panel and having side edges turned upwardly and then inwardly to define a pair of inturned side flanges parallel with and spaced above said panel; each shelf also having a pair of vertically-aligned openings in said panel and flanges, respectively, adjacent each corner of the rectangular shelf; and a plurality of tubular post segments spacing said shelves adjacent said corners and securing the same together to form said assembly; each tubular post segment having a lower body section and an upper generally cylindrical neck section of reduced cross sectional dimensions; said neck section of each post segment being dimensioned to extend upwardly through a pair of said vertically-aligned openings adjacent the corner of a shelf and terminating in an upper end portion adapted to be received in the body section of the next post segment directly thereabove; said aligned openings of each pair being formed in said panel and side flanges as generally circular openings slightly larger than the outside diameter of said neck sections and substantially smaller than that of said body sections of said post segments.

2. A shelving assembly comprising a plurality of inclined parallel rectangular metal shelves arranged in vertically-spaced series; each shelf having a support panel and having side edges turned upwardly and then inwardly to define a pair of inturned side flanges parallel with and spaced above said panel; each shelf also having a pair of vertically-aligned openings in said panel and flanges, respectively, adjacent each corner of the rectangular shelf; and a plurality of tubular post segments spacing said shelves adjacent said corners and securing the same together to form said assembly; each tubular post segment having a lower body section and an upper neck section of reduced cross sectional dimensions; said neck section of each post segment being dimensioned to extend upwardly through a pair of said vertically-aligned openings adjacent the corner of a shelf and terminating in an upper end portion adapted to be received in the body section of the next post segment directly thereabove, said aligned openings of each pair formed in said panel and side flanges being generally circular and slightly larger than the outside diameter of said neck sections and substantially smaller than that of said body sections of said post segments; and a secondary opening of circular configuration formed in said side flange adjacent each corner of each shelf; said secondary opening being vertically aligned with the opening in said panel therebelow when each said shelf is reoriented into a horizontal position; said secondary opening being adapted to receive the upstanding neck section of a post segment when such shelf is horizontally oriented.

3. The assembly of claim 2 in which the diameter of said secondary opening is the same as that of said openings formed in said panel.

4. The assembly of claim 2 in which the first-mentioned opening of each pair, as formed in said flanges, constitutes a primary opening; each of said secondary openings merging with one of said primary openings.

5. The assembly of claim 4 in which each secondary opening is closed by a plug secured therein; said plug having an arcuate indentation defining an arc of said primary opening.

6. The assembly of claim 5 in which said plug is selectively removable from and insertable into said secondary opening when said shelf and post segment are disconnected.

7. The assembly of claim 6 in which the neck section of each post segment, when received in the aligned openings of said panel and flange, locks said plug in place.

8. The assembly of claim 6 in which said plug is insertable into and removable from said primary opening when said shelf and post segment are disconnected; said arcuate indentation defining an arc of said secondary opening, and said scondary opening being adapted to receive the neck section of said post segment, when said shelf is horizontally reoriented.

9. The assembly of claim 8 in which said neck section of each post segment, when received in the aligned openings of said panel and flange of a horizontally reoriented shelf, locks said plug in place.

10. The assembly of claim 2 in which said shelves are reversible when horizontally reoriented so that said side flanges face downwardly.

11. The assembly of claim 8 in which each plug is removable from and insertable into one of said primary and secondary openings through the other of said primary and secondary openings only when said shelf and post segment are disconnected.

12. The assembly of claim 11 in which said plug includes upper and lower peripheral extensions adapted to engage top and bottom surfaces of said panel when said plug is in place.

13. The assembly of claim 5 in which said plug is formed of resilient material.

14. The assembly of claim 1 in which each of said shelves also includes upstanding front and rear walls.

15. The assembly of claim 14 in which said front and rear walls of at least one of said shelves has inwardly and downwardly turned lips along their upper margins; said lips being spaced from the inside surfaces of said front and rear walls to define depending channels; and a pair of insert strips extending along said front and rear walls and being retained within said channels by said lips.

16. The assembly of claim 15 in which each insert strip has a lower exposed portion thereof beneath the lip retaining the same; said exposed lower portion being provided with a plurality of horizontally-spaced recesses.

17. The assembly of claim 16 in which at least one shelf divider extends between said front and rear walls and has end portions received in opposing recesses of the respective insert strips.

18. The assembly of claim 17 in which said divider is formed of spring wire and includes an elongated intermediate portion disposed between said end portions; said end portions extending in planes parallel with said front and rear walls and normal to the plane of said panel.

19. The assembly of claim 18 in which said end portions have laterally-projecting tips extending along the lines of merger between said panel and said front and rear walls, respectively.

20. The assembly of claim 15 in which said panel of said one of said shelves is provided adjacent the front corners thereof with a pair of apertures; and a stop member having hook portions projecting downwardly through said apertures for detachably securing said stop member to said one shelf.

21. The assembly of claim 20 in which said stop member engages the insert strip retained along said front wall for simultaneously bracing said stop member and securing said insert strip in place.

22. A shelving assembly comprising a plurality of inclined parallel rectangular metal shelves arranged in vertically-spaced series; each shelf having a support panel and having side edges turned upwardly and then inwardly to define a pair of inturned side flanges parallel with and spaced above said panel; each side flange having first and second flange openings adjacent each shelf corner; said panel having at each shelf corner a panel opening vertically alignable with said first flange opening when said shelf is in an inclined position and with said second flange opening when said shelf is in a horizontal position; a plurality of vertical tubular post segments adjacent the corners of said shelves for securing said shelves together; each tubular post segment having a lower body section and an upper neck section of reduced diameter; said neck section of each post segment being dimensioned to extend upwardly through a panel opening and then through one of said first or second flange openings vertically aligned therewith, and terminating in an upper end portion adapted to be received in the body section of the next post segment directly thereabove.

23. The assembly of claim 22 in which said first and second flange openings merge with each other.

24. The assembly of claim 22 or 23 in which said panel opening and said first and second flange openings are all of the same diameter.

25. The assembly of claim 23 in which a plug is disposed in one of said first and second flange openings not vertically aligned with said panel opening.

26. The assembly of claim 25 in which said plug has an arcuate indentation receiving and engaging a portion of one of said post segments.

27. The assembly of claim 22 in which said shelves are reversibly mountable upon said post segments so that said neck section of each segment extends upwardly through a selected one of said first and second flange openings and then through the panel opening vertically aligned with said selected flange opening.

28. The assembly of claim 23 in which a plug is detachably mounted in each pair of merged first and second flange openings, said plug having an opening extending therethrough and being capable of being mounted in said pair of merged first and second flange openings in a first position wherein the plug opening extends through said first flange opening and a second position wherein said plug opening extends through said second flange opening, said plug opening being dimensioned for snugly receiving the neck section of a post segment.

29. The assembly of claim 28 in which said plug is formed of resilient polymeric material.

30. The assembly of claim 28 in which said pair of merged first and second flange openings define an aperture of generally oval configuration.

31. The assembly of claim 30 in which said plug is generally oval in configuration.

32. The assembly of claim 31 in which said oval plug has a perimetric groove adapted to receive the edge of said flange defining said oval aperture, said plug also including a lower portion having a beveled side wall adapted to be disposed between said flange and the panel of said shelf.

33. A shelving assembly comprising a plurality of parallel rectangular metal shelves arranged in vertically-spaced series; each shelf having a support panel and having side edges turned upwardly and then inwardly to define a pair of inturned side flanges parallel with and spaced above said panel; each shelf also having a pair of openings in said panel and flanges, respectively, adjacent each corner of the rectangular shelf; a plurality of tubular post segments spacing said shelves adjacent said corners and securing the same together to form said assembly; each tubular post segment having a lower body section and an upper neck section of reduced cross sectional dimensions; and a plug removably mounted in each of said flange openings; said plug having an opening therethrough and being capable of being mounted in said flange opening in a first position wherein the plug opening is vertically aligned with a panel opening when the shelf is horizontal and a second position wherein the plug opening is vertically aligned with such panel opening when the shelf is inclined; said neck section of each post segment being dimensioned to extend through said plug opening and vertically-aligned panel opening in the corner of a shelf and terminating in an upper end portion adapted to be received in the body section of the next post segment directly thereabove.

* * * * *